US006586870B1

(12) United States Patent
Carpinelli et al.

(10) Patent No.: US 6,586,870 B1
(45) Date of Patent: Jul. 1, 2003

(54) SPACE-SAVING CATHODE RAY TUBE EMPLOYING MAGNETICALLY AMPLIFIED DEFLECTION

(75) Inventors: Joseph Michael Carpinelli, Lawrenceville, NJ (US); Dennis John Bechis, Yardly, PA (US); George Herbert Needham Riddle, Princeton, NJ (US)

(73) Assignee: Sarnoff Corporation, Princeton, NJ (US)

( * ) Notice: Subject to any disclaimer, the term of this patent is extended or adjusted under 35 U.S.C. 154(b) by 348 days.

(21) Appl. No.: 09/615,423

(22) Filed: Jul. 13, 2000

Related U.S. Application Data

(63) Continuation-in-part of application No. 09/558,799, filed on Apr. 26, 2000, and a continuation-in-part of application No. 09/559,809, filed on Apr. 26, 2000.

(60) Provisional application No. 60/131,919, filed on Apr. 30, 1999, provisional application No. 60/160,654, filed on Oct. 21, 1999, and provisional application No. 60/160,772, filed on Oct. 21, 1999.

(51) Int. Cl.[7] ..... H01J 29/46; H01J 29/74; H01J 29/76

(52) U.S. Cl. ..... 313/442; 313/441; 313/443; 313/413; 313/426; 313/432; 313/433

(58) Field of Search ..... 313/421, 422, 313/426, 432, 433, 436, 439, 440, 442

(56) References Cited

U.S. PATENT DOCUMENTS

| | | | | | |
|---|---|---|---|---|---|
| 2,459,732 | A | * | 1/1949 | Bradley | 313/430 |
| 2,520,512 | A | | 8/1950 | Samson | |
| 3,185,879 | A | | 5/1965 | Evans, Jr. | |
| 3,524,197 | A | | 8/1970 | Soule | |
| 3,873,877 | A | * | 3/1975 | Machida et al. | 313/430 |
| 3,899,710 | A | * | 8/1975 | Machida et al. | 313/412 |
| 4,323,816 | A | | 4/1982 | Chang | |
| 4,329,618 | A | | 5/1982 | Chung | |
| 4,331,903 | A | * | 5/1982 | Takenaka et al. | 313/413 |
| 4,374,343 | A | | 2/1983 | Chang | |
| 4,443,737 | A | | 4/1984 | Van Tol | |
| 4,857,796 | A | | 8/1989 | Amano et al. | |
| 5,023,509 | A | * | 6/1991 | Deal et al. | 313/412 |
| 5,038,074 | A | * | 8/1991 | Nakamura | 313/430 |
| 5,327,044 | A | | 7/1994 | Chen | |

FOREIGN PATENT DOCUMENTS

| | | |
|---|---|---|
| DE | 11 80 853 B | 11/1964 |
| DE | 14 87 095 | 1/1969 |
| EP | 0 221 639 A | 5/1987 |
| EP | 0 334 438 | 9/1989 |
| EP | 0 418 962 | 3/1991 |
| GB | 469 455 A | 7/1937 |
| GB | 663 041 A | 12/1951 |
| GB | 865667 | 4/1961 |
| GB | 903587 | 8/1962 |
| GB | 2059144 | 4/1981 |
| GB | 2 114 806 A | 8/1983 |
| JP | 60200444 | 10/1985 |
| WO | WO 86/06211 A | 10/1986 |

OTHER PUBLICATIONS

International Search Report, PCT/US00/27445, Feb. 1, 2001, (3 Pages).

* cited by examiner

*Primary Examiner*—Nimeshkumar D. Patel
*Assistant Examiner*—Mariceli Santiago
(74) *Attorney, Agent, or Firm*—William J. Burke

(57) ABSTRACT

A cathode ray tube includes an electron gun directing electrons towards a faceplate having an electrode biased at screen potential. The electron beam (three beams in a color tube) is magnetically deflected to scan across the faceplate to impinge upon phosphors thereon to produce light depicting an image or information. A first pair of electromagnetic coils forward of the tube neck and deflection yoke is biased by a substantially constant current level to further deflect the electron beam. As a result, the electrons are deflected over a greater total angle than is obtained from the magnetic deflection yoke alone. A further pair of electromagnetic coils proximate the faceplate is biased by an oppositely poled substantially constant current level to direct electrons towards the faceplate, thereby to increase the landing angle of the electrons thereon.

30 Claims, 6 Drawing Sheets

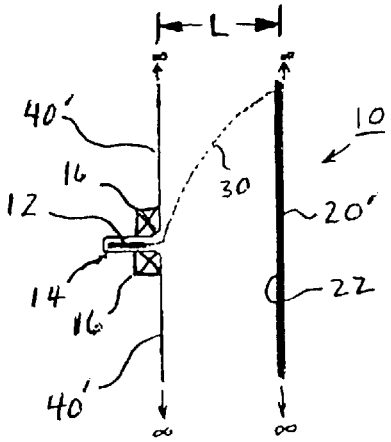
FIGURE 1
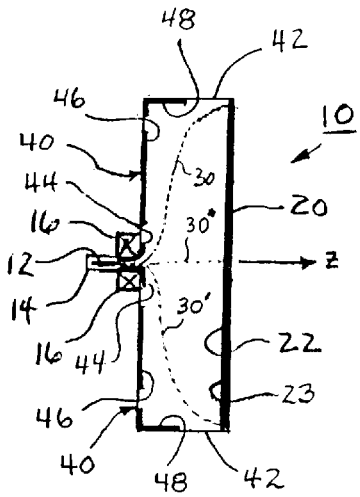
FIGURE 2
FIGURE 3
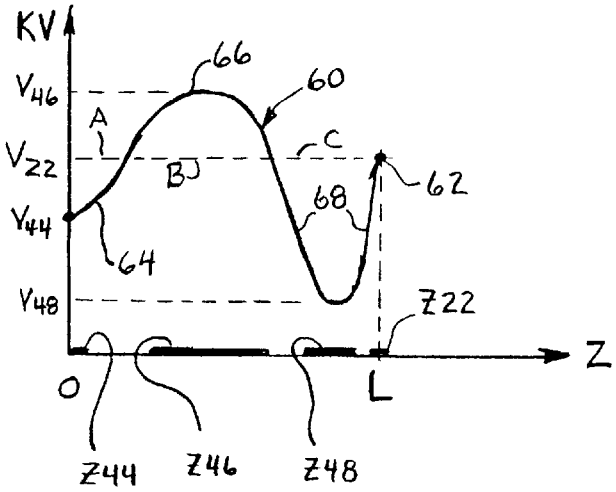
FIGURE 4
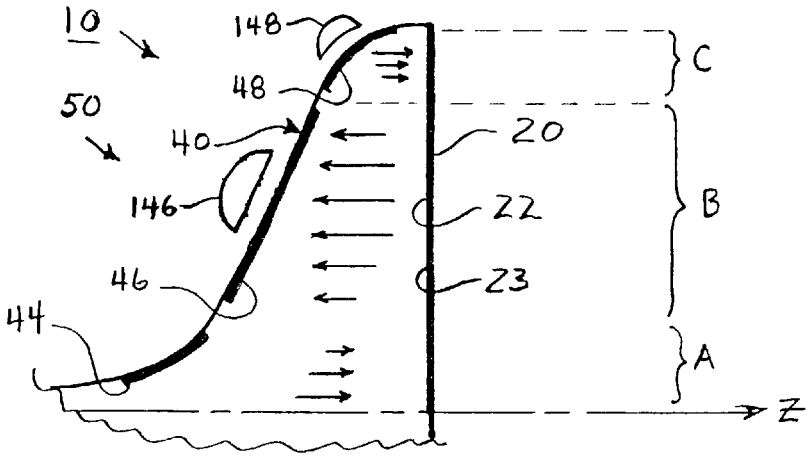

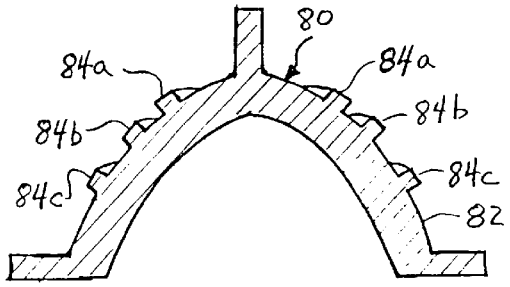
FIGURE 7A
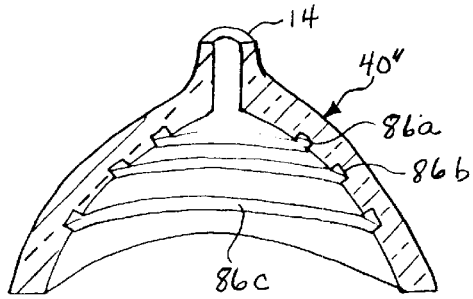
FIGURE 7B
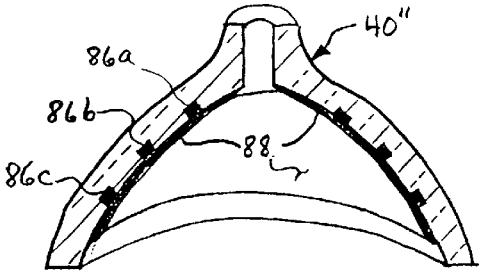
FIGURE 7C
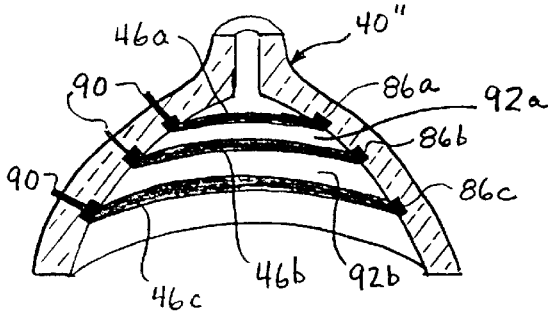
FIGURE 7D
FIGURE 8
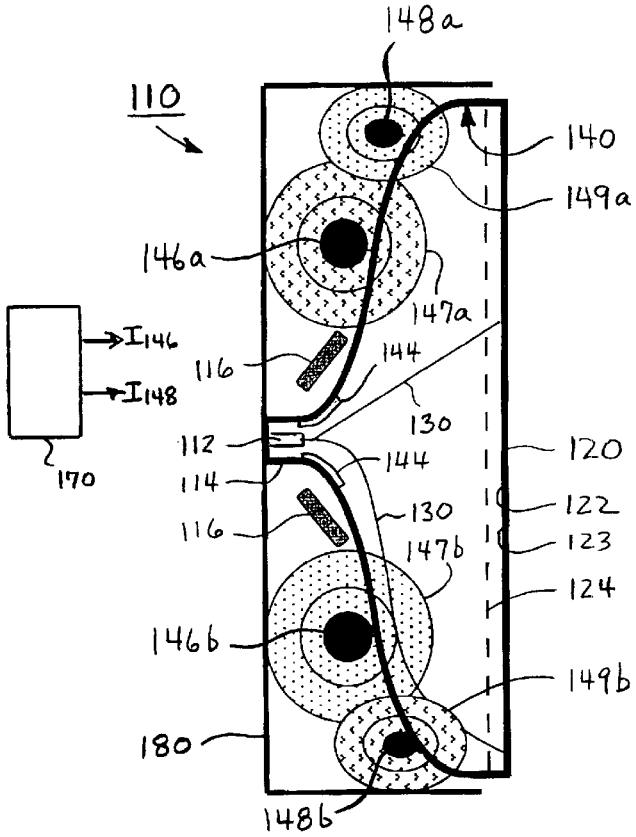

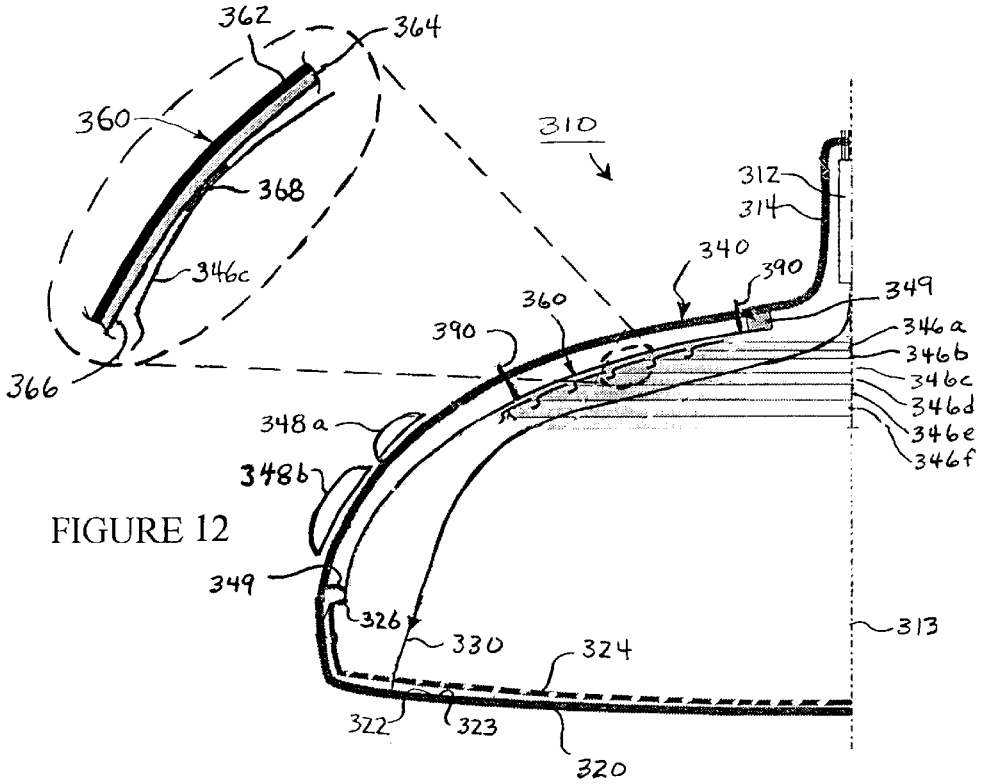
FIGURE 12
FIGURE 13
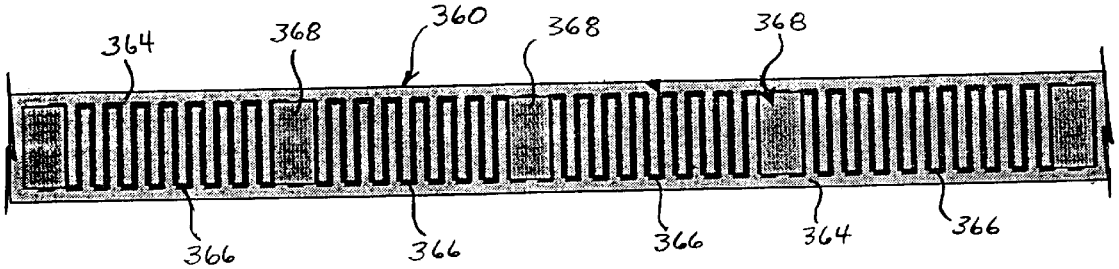

SPACE-SAVING CATHODE RAY TUBE EMPLOYING MAGNETICALLY AMPLIFIED DEFLECTION

This Application is a continuation-in-part of U.S. patent applications Ser. No. 09/558,799 file Apr. 26, 2000 and Ser. No. 09/559,809 filed Apr. 26, 2000, which claim the benefit of U.S. Provisional Application Ser. No. 60/131,919 filed Apr. 30, 1999, of U.S. Provisional Application Ser. No. 60/160,654 filed Oct. 21, 1999, and of U.S. Provisional Application Ser. No. 60/160,772 filed Oct. 21, 1999.

The present invention relates to a cathode ray tube and, in particular, to a cathode ray tube including one or more deflection aiding magnetic fields.

Conventional cathode ray tubes (CRTs) are widely utilized, for example, in television and computer displays. One or more electron guns positioned in a neck of a funnel-shaped glass bulb of a CRT direct a corresponding number of beams of electrons toward a glass faceplate biased at a high positive potential, e.g., 30 kilovolts (kV). The faceplate usually has a substantially rectangular shape and is generally planar or slightly curved. Together, the glass bulb and faceplate form a sealed enclosure that is evacuated. The electron gun(s) are positioned along an axis that extends through the center of the faceplate and is perpendicular thereto.

The electron beam(s) is (are) raster scanned across the faceplate so as to impinge upon a coating or pattern of phosphors on the faceplate that produces light responsive to the intensity of the electron beam, thereby to produce an image thereon. The raster scan is obtained by a deflection yoke including a plurality of electrical coils positioned on the exterior of the funnel-shaped CRT near the neck thereof. Electrical currents driven in first coils of the deflection yoke produce magnetic fields that cause the electron beam(s) to deflect or scan from side to side (i.e. horizontal scan) and currents driven in second coils of the deflection yoke produce magnetic fields that cause the electron beam(s) to scan from top to bottom (i.e. vertical scan). The magnetic deflection forces typically act on the electrons of the beam(s) only in the first few centimeters of their travel immediately after exiting the electron gun(s), and the electrons travel in a straight line trajectory thereafter, i.e through a substantially field-free drift region. Conventionally, the horizontal scan produces hundreds of horizontal lines in the time of each vertical scan to produce the raster-scanned image.

The depth of a CRT, i.e. the distance between the faceplate and the rear of the neck, is determined by the maximum angle over which the deflection yoke can bend or deflect the electron beam(s) and the length of the neck extending rearward to contain the electron gun. Greater deflection angles provide reduced CRT depth.

Modern magnetically-deflected CRTs typically obtain a ±55° deflection angle, which is referred to as 110° deflection. However, such 110° CRTs for screen diagonal sizes of about 62 cm (about 25 inches) or more are so deep that they are almost always provided in a cabinet that either requires a special stand or must be placed on a floor. For example, a 110° CRT having a faceplate with an about 100 cm (about 40 inch) diagonal measurement and a 16:9 aspect ratio, is about 60–65 cm (about 24–26 inches) deep. Practical considerations of increasing power dissipation producing greater temperature rise in the magnetic deflection yoke and its drive circuits and of the higher cost of a larger, heavier, higher-power yoke and drive circuitry make it disadvantageous to increase the maximum deflection angle in order to decrease the depth of the CRT.

A further problem in increasing the deflection angle of conventional CRTs is that the landing angle of the electron beam on the shadow mask decreases as deflection angle is increased. Because the shadow mask is as thin as is technically reasonable at an affordable cost, the thickness of the present shadow mask results in an unacceptably high proportion of the electrons in the electron beam hitting the side walls of the apertures in the shadow mask for low landing angles. This produces an unacceptable reduction of beam current impinging on the phosphor screen and a like decrease in picture brightness for low landing angles, e.g., landing angles less than about 25°.

One approach to this depth dilemma has been to seek a thin or so-called "flat-panel" display that avoids the large depth required by conventional CRTs. Flat panel displays, while desirable in that they would be thin enough to be hung on a wall, require very different technologies from conventional CRTs which are manufactured in very high volume at reasonable cost. Thus, flat panel displays are not available that offer the benefits of a CRT at a comparable cost. But a reduced-depth cathode ray tube as compared to a conventional CRT need not be so thin that it could be hung on a wall to overcome the disadvantage of the great depth of a conventional CRT.

Accordingly, there is a need for a cathode ray tube having a depth that is less than that of a conventional CRT having an equivalent screen-size.

To this end, the tube of the present invention comprises a tube envelope having a faceplate and a screen electrode on the faceplate adapted to be biased at a screen potential, a source of at least one beam of electrons directed toward the faceplate, wherein the source is adapted for magnetic deflection of the at least one beam of electrons, and phosphorescent material disposed on the faceplate for producing light in response to the at least one beam of electrons impinging thereon. At least first and second magnetic sources each produce a respective magnetic field. The first and second magnetic sources are disposed proximate the tube envelope to produce the respective magnetic fields therein and are disposed oppositely with respect to the source of at least one beam of electrons with the source of at least one beam of electrons being between the first and second magnetic sources. The first and second magnetic sources produce oppositely poled magnetic fields for tending to bend the at least one beam of electrons in a direction away from the faceplate.

According to a further aspect of the invention, a display comprises a tube envelope having a faceplate and a screen electrode on the faceplate biased at a screen potential, a source within the tube envelope of at least one beam of electrons directed toward the faceplate, a deflection yoke proximate the source of a beam of electrons for magnetically deflecting the beam of electrons, and phosphorescent material disposed on the faceplate for producing light in response to the beam of electrons impinging thereon. At least first and second electromagnets are disposed proximate the tube envelope with the source of a beam of electrons intermediate the first and second electromagnets, wherein the first and second electromagnets are oppositely poled for tending to bend the beam of electrons in a direction away from the faceplate. A source provides direct current bias for the first and second electromagnets and bias potential for the screen electrode.

BRIEF DESCRIPTION OF THE DRAWING

The detailed description of the preferred embodiments of the present invention will be more easily and better understood when read in conjunction with the FIGURES of the Drawing which include:

FIG. 1 is a cross-sectional schematic diagram of an exemplary embodiment of a cathode ray tube of interest in relation to the present invention;

FIG. 2 is a cross-sectional schematic diagram of an exemplary embodiment of a cathode ray tube of interest in relation to the present invention;

FIG. 3 is a graphical representation of the potential in the cathode ray tube of FIG. 2;

FIG. 4 is a cross-sectional schematic diagram of the tube of FIG. 2 illustrating the electrostatic forces therein;

FIGS. 7A–7D are cross-sectional schematic diagrams showing a method of forming an electrode structure in a cathode ray tube according to the invention;

FIG. 8 is a cross-sectional schematic diagram of an alternative exemplary structure providing appropriately positioned electromagnets proximate a cathode ray tube to establish a predetermined magnetic field therein in accordance with the invention;

FIG. 12 is a partial cross-sectional schematic diagram of another alternative exemplary structure providing appropriately positioned electrodes within a cathode ray tube for use with electromagnets in accordance with the invention;

FIG. 13 is a schematic diagram of a support useful in the tube structure shown in FIG. 12.

Figure 5:
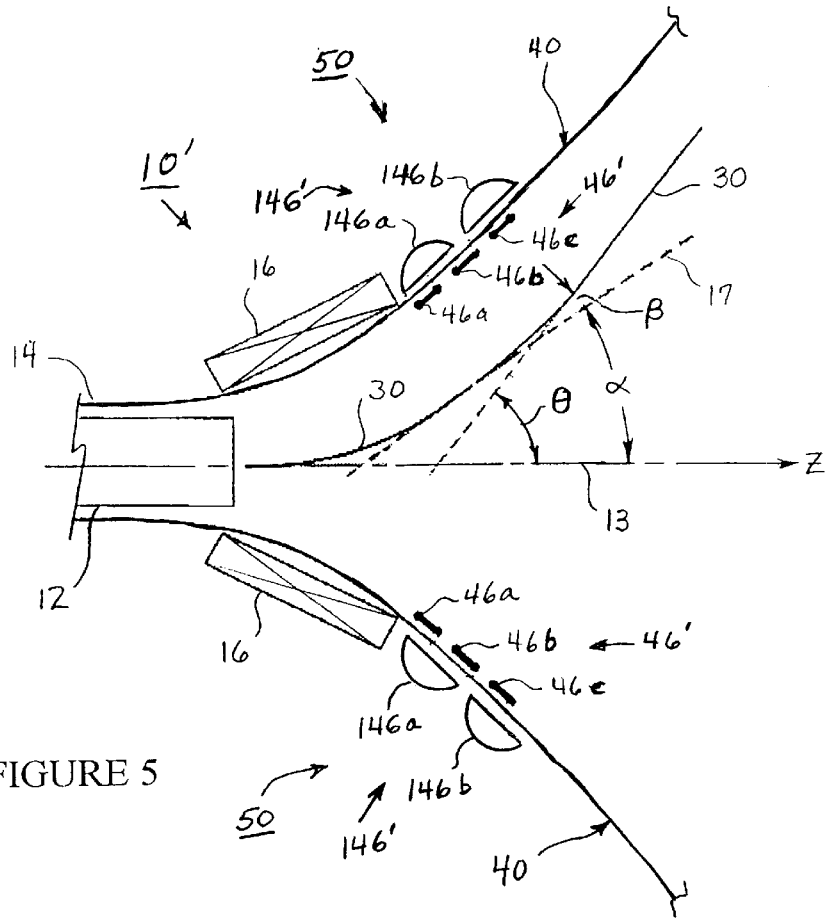
FIG. 5 is a partial cross-sectional schematic diagram of the yoke funnel region of an exemplary tube in accordance with the invention which tube includes a modification of the tube of FIG. 2.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification, but in the Drawing are preceded by digits unique to the embodiment described. For example, a particular element may be designated as "xx" in one figure, by "1xx" in another figure, by "2xx" in another figure, and so on.

DESCRIPTION OF THE PREFERRED EMBODIMENTS

In a cathode ray tube according to the present invention, the electrons of the electron beam(s) are further deflected after leaving the influence of the magnetic deflection yoke, i.e. in what is referred to as the "drift region" of a conventional CRT through which the electrons travel in substantially straight lines. In a conventional CRT, the electrons are at the screen or anode potential at the time they leave the gun and deflection regions and, not being under the influence of any electric or magnetic field, travel in straight lines to the screen or faceplate thereof. Such cathode ray tube may find application, for example, in television displays, computer displays, projection tubes and other applications where it is desired to provide a visual display.

FIG. 1 is a cross-sectional diagram of a cathode ray tube 10 of interest in relation to the present invention in its simplest form. It is noted that unless otherwise specified, such cross-sectional diagrams may be considered to illustrate either the horizontal or the vertical deflection orientation because both appear similar in such diagrams.

In exemplary cathode ray tube 10 of FIG. 1, electrons produced by electron gun 12 located in tube neck 14 are directed towards faceplate 20 which includes a screen or anode electrode 22 which is biased at a relatively high positive potential. The electrons forming electron beam 30 produced by electron gun 12 are deflected by magnetic fields produced by deflection yoke 16 to scan across the dimension of faceplate 20. Tube 10 is illustrated in FIG. 1 in a somewhat theoretical way with two infinite parallel flat plates 20', 40' separated by a distance "L" representing the distance between flat backplate 40' and flat faceplate 20'. Backplate 40 is also biased to a relatively high positive potential, but preferably less than the potential of screen electrode 22, to which lesser potential the ultor of gun 12 may also biased for avoiding unusual electron-injection effects. Under the influence of electrostatic forces produced by the relatively high positive potential bias of backplate 40 and the magnetic field produced by deflection yoke 16, electron beam 30 is deflected over a total deflection angle. A coating of phosphorescent material 23 is disposed on faceplate 20 for producing light in response to the beam of electrons 30 impinging thereon, thereby providing a monochromatic display. For a color display, a pattern of different phosphorescent materials 23 is disposed on faceplate 20 for producing different colors of light in response to three beams of electrons 30 (e.g., one each for red, green and blue) impinging thereon through apertures in a shadow mask (not shown), thereby providing a color display. Herein, electron beam 30 should be understood to represent plural beams of electrons in relation to a color display or if a color display is desired.

Further control of the bias potentials on the backplate of the tube to create a particular electrostatic and/or electrodynamic field may be employed in accordance with the invention to control the trajectories of the electrons of the electron beam 30, thereby to reduce the required distance between the faceplate 20 and backplate 40 of an exemplary tube 10, as shown in FIG. 2, and to change the landing angle of the electron beam 30 therein. Tube 10 includes a gun 12 in neck 14 generally symmetrically located substantially at the center of a backplate 40 to direct a beam of electrons 30 towards faceplate 20 which includes a screen electrode 22 biased at a relatively high positive potential. Faceplate 20 and backplate 40 are of similar size and are joined by an annular end plate 48 to form a sealed container that can be evacuated. Deflection yoke 16 surrounds neck 14 in the region of its juncture with backplate 40 for magnetically deflecting electrons generated by gun 12 as they proceed out of gun 12 and toward faceplate 20 to impinge upon the phosphor(s) 23 thereon. While tube 10 is illustrated as having a substantially rectangular in cross-section in FIG. 2, the glass envelope 40–42 of a typical glass tube 10 will more closely follow the shape of the widest trajectories 30, 30' and so will resemble the shape of a conventional CRT, but be shorter in depth, and the cross-section perpendicular to the central Z axis is preferably more rectangular which tends to reduce the power required to drive magnetic deflection yoke 16.

Electrostatic fields are established within tube 10 by a number of conductive electrodes located on or close to backplate 40 and biased at respective positive potentials, i.e. at potentials of like polarity to that of the screen or anode electrode 22. A first electrode 44 surrounding the outlet of gun 12 in the vicinity of neck 14 is biased at a positive potential that is preferably less than the potential at screen electrode 22. The electrostatic field produced by electrode 44 results in the electrons of the electron beam 30 being slower moving proximate yoke 16, and therefore more easily deflected by yoke 416. The result of the cooperation between electrode 44 and yoke 16 may be utilized to realize either a reduction of yoke power, and therefore a smaller, lighter, less expensive and likely more reliable deflection yoke 416, or a greater deflection angle with the same yoke power and yoke.

A second electrode 46 also surrounding the outlet of gun 12, but spaced away from the vicinity of neck 14, is biased at a positive potential that is preferably greater than the potential at screen electrode 22. The electrostatic field produced by second electrode 46 causes the electrons of beam 30 (and of its opposite extreme 30") to travel in a parabola-like path that bends their trajectories away from faceplate 20, thereby increasing the deflection angle from that produced by magnetic deflection yoke 16 alone, and also decreasing the landing angle of electron beam 30. It is desirable that electrode 46 be positioned so that the action of the electrostatic field of electrode 46 not act on the electrons of electron beam 30 until after they have been substantially fully acted upon by deflection yoke 16.

The landing angle is the angle at which the electron beam 30 impinges upon screen electrode 22, and in a color CRT, the shadow mask proximate thereto. As may be seen in FIG. 2 by comparing electron beams 30, 30' which impinge upon faceplate 20 near its periphery and electron beam 30" that impinges thereon near its center, the landing angle becomes smaller as the distance from the central or Z axis of tube 10 becomes greater and/or as the deflection angle of the electron beam 30 increases. Because the shadow mask has a finite non-zero thickness, if the landing angle is too small, e.g., less than about 25°, too many of the electrons will hit the sides of the apertures in the shadow mask instead of passing therethrough, thereby reducing the intensity of the electron beam reaching the phosphor on the faceplate 20 and of the light produced thereby.

Electrode 48 is located distal the central or Z axis of tube 10 and near the periphery of faceplate 20 where the landing angle is smallest. A third electrode 48 surrounding the outlet of gun 12 but substantially at the periphery of backplate 40 is biased at a positive potential that is preferably less than the potential at screen electrode 22 to direct the electrodes of beams 30 and 30" back towards faceplate 20 for increasing the landing angle of electron beams 30, 30' near the periphery of faceplate 20. Electrode 48 may be biased to a potential less than the potential at neck electrode 44 where desired to provide greater reduction of landing angle. Thus, the electrostatic fields created by electrodes 46 and 48 complement each other in that electrode 46 increases the deflection angle which decreases the landing angle at the periphery of faceplate 20, and electrode 48, which has its strongest effect near the periphery of faceplate 20, acts to increase the landing angle in the region where it might otherwise be undesirably small.

The relationship and effects of the electrostatic fields described above cooperate in a tube 10 that is shorter in depth than a conventional CRT and yet operates at a comparable and/or reasonable deflection yoke power level. An exemplary potential distribution over the depth of tube 10 along its Z axis is illustrated in FIG. 3. Potential characteristic 60 is plotted on a graph having distance from the exit of gun 12 along the ordinate and bias potential in kilovolts along the abscissa. Electrode 22 located at a distance L from gun 12 and represented by region $Z_{22}$ is biased at a relatively high positive potential $V_{22}$ represented at point 62. In order beginning with gun 12 at Z=0 are neck electrode 44 located proximate gun 12 and represented by electrode region $Z_{44}$, electrode 46 located intermediate gun 12 and faceplate 20 and represented by electrode region $Z_{46}$, and electrode 48 located more proximate to faceplate 20 and represented by electrode region $Z_{48}$. Electrode 44 is biased at an intermediate positive potential $V_{44}$ and electrode 46 is biased at a relatively high positive potential $V_{46}$ that is preferably higher than the screen potential $V_{22}$. Electrode 48 is biased at an intermediate positive potential $V_{48}$ that is preferably lower than screen potential $V_{22}$ (but could be equal thereto) and could preferably be lower than gun ultor potential $V_{44}$.

Electrodes 44, 46, 48, 22 and bias potentials $V_{44}$, $V_{46}$, $V_{48}$, $V_{22}$ thereon produce the potential characteristic 60 that has a portion 64 in region A rising towards the screen potential $V_{22}$ thereby tending to slow the acceleration of electrons towards faceplate 20 to provide additional flight time during which the electrostatic and/or magnetic fields of portions 66 and 68 act upon the electrons. Characteristic 60 has a portion 66 in region B in which the potential peaks at a level relatively higher than the screen potential $V_{22}$ thereby to cause the electrons to move along trajectories that depart further from central axis Z of tube 10 to increase the deflection angle. In portion 68 in region C, the potential characteristic 60 bottoms at a level lower than the screen potential $V_{22}$ and the gun potential $V_{44}$ thereby to cause the electrons to move along trajectories that turn toward faceplate 20 of tube 10 to increase the landing angle of the electron beam near the edges of faceplate 20.

It is noted that the location of the gap between electrodes 44 and 46 can strongly affect the operation of tube 10. If electrode 46 having a relatively very high positive potential bias extends too close to the exit of gun 12 (and/or neck electrode 44 does not extend sufficiently far therefrom), then the electrons emitted from gun 12 are accelerated and additional magnetic deflection effort is required of deflection yoke 16 (e.g., additional yoke 16 power, field and/or size) to provide the desired magnetic deflection. On the other hand, if neck electrode 44 extends too far beyond the exit of gun 12, then the electrons spend too much time in region A in which electrostatic forces act counter to the deflection sought to be produced by magnetic deflection yoke 16, thereby also increasing the power, field and/or size required of yoke 16 to deflect the electron to the corners of faceplate 20, even with the beneficial effect of yoke amplifier 50. Because electrode 46 in tube 10 acts to amplify the total deflection of electron beam 30 above that produced by yoke 16, i.e. it tends to bend the electron beams in a direction away from the center of the faceplate, it may be referred to as a "yoke amplifier" and identified as 50.

The particular values of bias potential are selected in accordance with a particular tube 10 to obtain, for example, a suitable balance of reduced tube depth and reasonable yoke power in consideration of the effects of each of the bias potentials. For example, as the bias potential $V_{44}$ of the ultor of gun 12 is increased, the required deflection power of yoke 16 increases and the depth of tube 10 decreases, indicating that a bias potential of intermediate value is desirable. Thus, an about 80–100-cm diagonal 165° deflection tube with $V_{22}$=30 kV and $V_{44}$=20 kV is about 13.5–15 cm (about 5.4–6 inches) shorter than a conventional 110° CRT of like screen size. A constant bias potential $V_{46}$ on electrode 46 causes the electrons to follow a substantially parabolic trajectory toward faceplate 20 in region B, however, increasing the bias potential $V_{46}$ reduces the electrostatic forces pulling electrons towards faceplate 20, so that a bias potential $V_{46}$ that is near or greater than the screen potential $V_{22}$ is advantageous to cause the electrons to travel in a more nearly straight line trajectory or to curve away from faceplate 20, thereby to increase the deflection angle Θ and reduce the depth of tube 10. Thus, a bias potential $V_{46}$ of about 30–40 kV is desirable, but, for safety, should be kept below the potential at which X-rays that could penetrate the envelope of tube 10 could be generated, i.e. below about 35 kV. Finally, bias potential $V_{48}$ is preferably a low positive potential to provide an electrostatic force that turns the electrons deflected to the edge regions of faceplate 20 more toward faceplate 20 to increase the landing angle, preferably to above 25°. This field accelerates the electrons towards faceplate 20 after their having been deflected by yoke 16 and by the electrostatic field forces produced by bias potential $V_{46}$ and electrode 46.

It is anticipated that the depth of tube 10 in accordance with the invention can be reduced by about a factor of two as compared to a conventional 110° CRT, to provide a 100-cm (about 40-inch) diagonal 16:9 aspect ratio tube 10 having a total depth of about 35–36 cm (about 14 inches) including the neck 14. Further reduction of about 5 cm (about 2 inches) can be obtained if a bent gun that does not project directly rearward from backplate 40 is employed. It is noted that shaping backplate 40 (i.e. the glass funnel of tube 10) to more closely conform to the trajectories of the furthest deflected electron beams 30, 30' improves the effectiveness of the electrostatic forces produced by electrodes 44, 46, 48, thereby allowing the depth of tube 10 to be reduced. In addition, the gradual potential change over distance illustrated in FIG. 3 enables a larger diameter electron beam 30 where electron beam 30 exits gun 12, thereby reducing space charge dispersion within electron beam 30 to provide a desirably smaller beam spot size at faceplate 20. The spot size and divergence of electron beam 30 is controlled by the particular electron gun and the convergence of the desired yoke.

FIG. 4 is an exemplary embodiment of tube 10 (only half of tube 10 being illustrated because tube 10 is symmetrical about the Z axis, i.e. in what could be designated the X-Z plane and the Y-Z plane) of the sort mentioned above having a backplate shaped similarly to the most extremely deflected electron beams 30, 30' and having electrodes 22, 44, 46, 48 biased as described above to produce a potential distribution as in FIG. 3. In FIG. 4, however, the electron beams 30 are not illustrated, but arrows are shown directed either towards or away from faceplate 20 representing the net force acting on the electrons of beam 30 as they pass through the regions A, B and C as described above. Such forces may be produced by an electrostatic field as illustrated, or may be produced in accordance with the present invention by a magnetic field or by a combination of electrostatic and magnetic fields. Tube 10 according to the invention includes either electromagnet 146, electromagnets 146 and 148, electromagnet 146 and electrode 48, or electrode 46 and electromagnet 148.

In region A, the net electrostatic force directs the electrons towards faceplate 20 under the influence of the relatively high positive bias potential $V_{22}$ of screen electrode 22 and the intermediate positive bias potential $V_{44}$ on neck electrode 44. In region B, the net force (which may be either electrostatic or magnetic) deflects the electrons away from the center of faceplate 20 under the influence of either the relatively very high bias potential on backplate electrode 46, which exceeds the relatively high positive bias potential $V_{22}$ on screen electrode 22, or the magnetic field produced by electromagnet 146. In region C, the net force (which may be electrostatic or magnetic) again directs the electrons towards faceplate 20 under the influence of either the screen electrode 22 relatively high positive bias potential as assisted by the low positive bias potential $V_{48}$ on electrode 48 or by the magnetic field produced by electromagnet 148.

It is particularly noted that by virtue of the effect of the force produced by the relatively very high bias potential on backplate electrode 46 (i.e. higher than the bias potential $V_{22}$ of screen electrode 22) or by electromagnet 146, the deflection of the electron beam 30 is increased beyond that produced by the magnetic deflection of yoke 16. Thus, electrode 46 or electromagnet 146 in tube 10 acts to amplify the total deflection above that produced by yoke 16, and so is referred to as a "yoke amplifier" and identified as 50. In particular, note that the deflection amplification produced by the yoke amplifier 50 is directly related to the deflection of any particular electron by yoke 16. In other words, electrons moving towards faceplate 20 along or near the Z axis (i.e. those undeflected or little deflected by yoke 16) are minimally affected by the yoke amplifier 50. Those electrons deflected by yoke 16 to land intermediate the Z axis and the edge of faceplate 20 are additionally deflected away from the center of faceplate 20 by yoke amplifier 50 because they pass through a portion of region B in which yoke amplifier 50 acts. Those electrons deflected by yoke 16 to land near the edge of faceplate 20 are additionally deflected away from the center of faceplate 20 an even greater amount by the yoke amplifier 50 because they pass through the entirety of region B in which yoke amplifier 50 acts and so are more strongly affected thereby. Yoke amplifier 50 may also be considered to include neck electrode 44 which, when biased at a potential less than the screen potential, beneficially reduces the effort or power required by deflection yoke 16 to obtain a given deflection of electron beam 30.

It is also noted that tube 10 may also be advantageous because it "looks like a conventional CRT" with a shaped glass bulb and neck, and a planar or slightly curved faceplate, and so may utilize similar manufacturing processes as are utilized for conventional CRTs. The issues of space charge effects expanding the electron beam are also similar to those in conventional CRTs and so the spot size variation with a smaller spot at the center of the faceplate and a somewhat larger spot size at the edges and corners is similar to that of the conventional CRT, although the structure and operation of tube 10 is very different therefrom. While the inventive tube 10 of FIG. 4 substantially reduced the front-to-back tube depth, the improvement is in the conical section of the glass bulb. In addition, the length of the tube neck 14 necessary to contain electron gun 12, typically less than about 23–25 cm (about 9–10 inches), can be reduced if a shorter electron gun 12 is employed.

The advantage of the additional deflection provided by electromagnet 146 may also be realized as aiding the deflection effort of deflection yoke 16. Because electromagnet 146 increases the deflection, the deflection provided by deflection yoke 16, and the power required to drive deflection yoke 16, i.e. the energy needed to be stored in the magnetic field of deflection yoke 16, may be reduced by employing magnetic deflection amplifier 50. For example, the table below illustrates the dramatic reduction of the energy that must be stored in deflection yoke 16 as the deflection contribution of magnetic deflection amplifier 50 increases.

| Total Deflection Angle | Yoke Amplifier 50 Contribution | Deflection Yoke 16 Contribution | Normalized Yoke 16 Energy |
|---|---|---|---|
| 100° | 0° | 100° | 1.00 |
| 100° | ±5° | 90° | 0.82 |
| 100° | ±10° | 80° | 0.66 |
| 100° | ±15° | 70° | 0.51 |
| 110° | 0° | 110° | 1.00 |
| 110° | ±15° | 100° | 0.84 |
| 110° | ±10° | 90° | 0.69 |
| 110° | ±15° | 80° | 0.55 |

FIG. 5 is a partial cross-sectional diagram of an alternative embodiment of tube 10 identified as tube 10' in which either electrode 46 of tube 10 is replaced by an alternative electrode 46' comprising a plurality of electrodes each having a particular value of bias potential applied thereto, or electromagnet 146 is replaced by an alternative electromagnet 146' comprising a plurality of electromagnets each providing a particular strength of magnetic field within tube 10. In practice, such plural electromagnets may be separate electromagnets or may be different windings placed on a shaped core of ferrite or other magnetic material in a manner to provide the desired variation of magnetic field strength.

Alternative electrode 46' includes, for example, three electrodes 46*a*, 46*b*, 46*c*, spaced apart along a section of tube backplate 40 forward of gun 12, neck 14 and magnetic deflection yoke 16. Alternative electromagnet 146' includes, for example, two electromagnets 146*a*, 146*b*, spaced apart along a section of tube backplate 40 forward of gun 12, neck 14 and magnetic deflection yoke 16. Electron beam 30 exits gun 12 directed towards faceplate 20 (not visible) and is magnetically deflected by an angle $\alpha$, a high value of which is represented by dashed line 17, typically up to an angle of ±55° with a conventional yoke 16 for a 110° tube. In addition, electron beam 30 is deflected up to an additional angle $\beta$ under the action of the yoke amplifier 50 effect produced by the electrostatic fields produced by the relatively high positive bias potentials of electrode 46' or by the magnetic fields produced by electromagnets 146' to have a total deflection angle $\Theta$ with respect to Z axis 13.

It is noted that electromagnet 146 includes a pair of oppositely poled but substantially similar electromagnets 146 disposed substantially symmetrically on tube envelope 40 with respect to neck 14, and may include a pair of electromagnets having their elongated dimension oriented in a vertical direction about neck 14 for increasing deflection of electron beam 30 in a horizontal direction on faceplate 20 (i.e. increasing the width of the image display thereon). In addition, electromagnet 146 may also include a separate pair of electromagnets having their elongated dimension oriented in a horizontal direction for increasing the vertical deflection of electron beam 30. Similarly, electromagnet 148 includes a pair of substantially similar electromagnets 148 disposed substantially symmetrically on tube envelope 40 with respect to neck 14. In addition, electromagnet 148 may include horizontally and/or vertically oriented electromagnets for bending electron beam 30 towards faceplate 20 near the edges thereof. The pairing of electromagnets is evident in FIG. 5, for example, where both halves of a symmetrical tube envelope 40 are illustrated, but is not as apparent in illustrations of only one of the symmetrical halves of tube 10, e.g., FIG. 4. Of course, if tube neck 14 is not centrally symmetric with respect to faceplate 20, then electromagnets 146 and/or 148, or both, would be pairs of non-similar electromagnets that differ so as to accommodate the lack of symmetry in the position of electron gun 12 in neck 14. While the description herein refers to electromagnets, it is understood that permanent magnets, shaped and magnetized to produce the equivalent magnetic field, may replace the described electromagnets within the scope of the present invention.

It is also noted that electromagnet 146, whether a single pair electromagnet 146 or plural pairs of electromagnets 146*a*, 146*b*, . . . , may be referred to as a "yoke amplifier," a "deflection amplifier" an "electromagnetic deflection amplifier" or a "magnetic deflection amplifier" 50 because it increases the deflection of electron beam 30 beyond the deflection produced by deflection yoke 16. Similarly, electrode 46, whether a single electrode 46 or plural subelectrodes 46*a*, 46*b*, . . . , may be referred to as a "yoke amplifier," a "deflection amplifier" or an "electrostatic deflection amplifier" 50 because it similarly increases the deflection of electron beam 30 beyond the deflection produced by deflection yoke 16. In particular, the amount of increase in the deflection of electron beam 30 increases as the angle of deflection produced by yoke 16 increases. For example, electron beam 30 when directed along central axis 13 or only slightly deflected therefrom, e.g., by about 20° or less, continues to travel in a substantially straight trajectory and is minimally affected by electrode 46 or electromagnet 146.

In tube 10' the electrodes 46*a*–46*f* are preferably biased at different relatively high positive potentials so as to more precisely shape the potential characteristic thereof (similar to characteristic 60 of FIG. 3) while not accelerating the electrons of electron beam 30 towards faceplate 22. Each of electrodes 46*a*–46*f* is preferably a ring electrode proximate tube backplate 40 and typically having a "generally rectangular shape" surrounding Z axis 13 along which is electron gun 12. Typical bias potentials for electrodes 46*a*–46*f* are, for example, 30 kV, 32 kV, 34 kV, 35 kV, 33 kV and 31 kV, respectively, with each of gun 12 and screen electrode 22 (not visible) biased to 30 kV, although the bias potential for gun 12 could be lower than that of screen electrode 22.

In tube 10' the electromagnets 146*a*–146*b* are preferably biased at different relative electromagnetic field strengths so as to more precisely shape the electromagnetic field characteristic thereof (analogously to characteristic 60 of FIG. 3) while not accelerating the electrons of electron beam 30 towards faceplate 22. Each of electromagnets 146*a*–146*b* is preferably a generally bar shaped electromagnet having a relatively flat side proximate and preferably shaped to generally conform to the shape of tube backplate 40 so as to more efficiently produce magnetic field within tube envelope 40 and typically being disposed symmetrically in an X-axis or Y-axis direction with respect to central Z axis 13 of tube 10' along which is electron gun 12.

As used herein, "generally rectangular shape" or "substantially rectangular" refers to a shape somewhat reflective of the shape of faceplate 20 and/or the cross-section of tube envelope 40 when viewed in a direction along Z axis 13. A generally rectangular shape may include rectangles and squares having rounded comers as well as concave and/or convex sides, so as to be suggestive of dog-bone shapes, bow-tie shapes, racetrack shapes, oval shapes and the like. It is noted that by so shaping electrodes 44, 46 and/or 48, the required waveform of the drive current applied to yoke 16 may be simplified, e.g., made closer to a linear waveform or to another waveform as may be desired for a particular tube and scan type, such as interlaced and non-interlaced scan and bi-directional scan. Electrodes 44, 46, 48 may be oval in shape or even almost circular, particularly where the cross-section of tube envelope 40 is of such shape, as is often the case at the rearward portions thereof, such as those proximate neck 14 and yoke 16.

Figure 6:
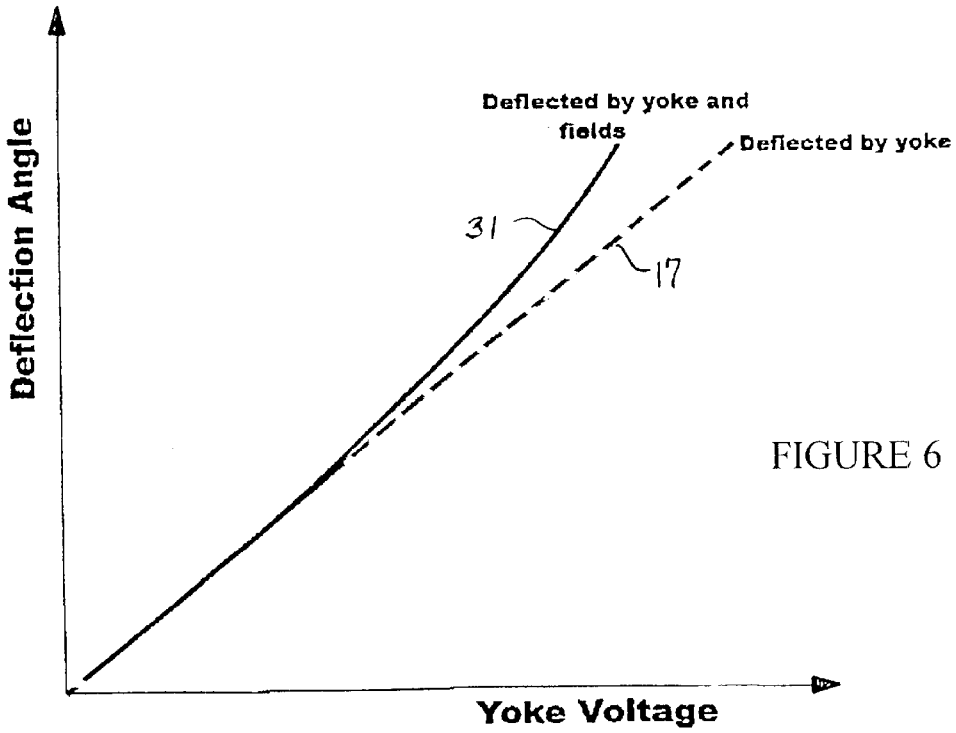
FIG. 6 is a graphical representation illustrating the performance of the cathode ray tube of FIG. 2 and/or FIG. 5.

The total deflection angle Θ obtained is the sum of the yoke 16 deflection angle α and the additional deflection angle β produced by electrode 46' and/or electromagnet 146'. The yoke deflection angle α is directly proportional to the deflection current applied to yoke 16 as illustrated by dashed line 17 of FIG. 6. The additional electrostatic deflection angle β is greater for greater yoke deflections, as described above in relation to tube 10. The deflection represented by angles α and β combine to produce the total deflection angle Θ represented by line 31. The deflection amplifying effect results from the action of the electric fields produced by electrodes 46*a*–46*f* or by electromagnets 146*a*–146*b* on the electrons of electron beam 30 to produce a net force (integrated over the electron path) that pulls the electrons away from centerline 13 of tube 10', thereby increasing the total deflection angle Θ. This effect is aided by the bias potential on at least some or all of electrodes 46*a*–46*f* being greater than the potential of screen electrode 22 or by the electromagnetic field on at least some or all of electromagnets 146*a*–146*b* being sufficient to overcome the attractive effect of the bias potential of screen electrode 22.

The structure of electrode 46 or plural electrodes 46', or of electrode 48 or plural electrodes comprising electrode 48, may be of several alternative forms. For example, such electrodes 46, 46*a*–46*f*, or 48 may be shaped metal strips printed or otherwise deposited in a pattern on the inner surface of the funnel-shaped glass backplate 40 of tube 10' and connected to a source of bias potential by conductive feedthrough connections penetrating the glass wall of funnel backplate 40. The shaped metal strips can be deposited with a series of metal sublimation filaments and a deposition mask that is molded to fit snugly against the glass wall or backplate 40. If a large number of strips 46*a*, 46*b*, . . . , or 48, . . . , are employed, each of the strips 46*a*, 46*b*, . . . , or 48, . . . need only be a few millimeters wide and a few microns thick, being separated by a small gap, e.g., a gap of 1–2 mm, so as to minimize charge buildup on the glass of backplate 40. A smaller number of wider strips 46, 46*a*–46*f*, or 48 of similar thickness and gap spacing could also be employed. Deposited metal strips 46, 46*a*, 46*b*, . . . , or 48, . . . are on the surface of glass backplate 40 thereby maximizing the interior volume thereof through which electron beam 30 may be directed.

Although bias potential could be applied to each of strips 46, 46*a*, 46*b*, . . . , or 48, . . . by a separate conductive feedthrough, having too large a number of feedthroughs could weaken the glass structure of backplate 40. Thus, it is preferred that a vacuum-compatible resistive voltage divider be employed within the vacuum cavity formed by backplate 40 and faceplate 20, and located in a position shielded from electron gun 12. Such tapped voltage divider is utilized to divide a relatively very high bias potential to provide specific bias potentials for specific metal strips 46, 46*a*, 46*b*, . . . , or 48 . . . .

One form of suitable resistive voltage divider may be provided by high-resistivity material on the interior surface of glass tube envelope 40, such as by spraying or otherwise applying such coating material thereto. Suitable coating materials include, for example, ruthenium oxide, and preferably exhibit a resistance is in the range of $10^8$ to $10^{10}$ ohms. The high-resistivity coating is in electrical contact with the metal electrodes 44, 46, 46', or 48 for applying bias potential thereto. The thickness and/or resistivity of such coating need not be uniform, but may be varied to obtain the desired bias potential profile. Beneficially, so varying such resistive coating may be utilized for controllably shaping the profile of the bias potential over the interior surface of tube envelope 40, for example, to obtain the applicable portion of a bias potential profile such as that illustrated in FIG. 3. Thus, the complexity of the structure of electrodes 44, 46, and/or 48 may be simplified and the number of conductive feedthroughs penetrating tube envelope 40 may be reduced. In addition, such a high-resistivity coating may be applied in the gaps between electrodes, such as electrodes 44, 46, or 48, to prevent the build up of charge due to electrons impinging thereat.

An alternative to the masked deposition of metal strips 46*a*, 46*b*, . . . , or 48, . . . described above, the process illustrated in simplified form in FIGS. 7A–7D by way of example with respect to electrodes 46*a*, 46*b*, 46*c*, can be utilized. A mold 80 has an outer surface 82 that defines the shape of the inner surface of the funnel-shaped glass bulb 40" of a cathode ray tube 10' and has raised patterns 84*a*, 84*b*, 84*c* thereon defining the reverse of the size and shape of the metal strips 46*a*, 46*b*, 46*c*, as shown in FIG. 7A. Upon removal from mold 80, glass bulb 40" has a pattern of grooves 86*a*, 86*b*, 86*c* in the inner surface thereof of the size and shape of the desired metal stripes 46*a*, 46*b*, 46*c*, as shown in FIG. 7B. Next, metal such as aluminum is deposited on the inner surface of glass bulb 40" sufficient to fill grooves 86*a*, 86*b*, 86*c*, as shown in FIG. 7C. Then, the metal 88 is removed, such as by polishing or other abrasive or removal method, to leave metal strips 46*a*, 46*b*, 46*c* in grooves 86*a*, 86*b*, 86*c*, respectively, of glass bulb 40", with gaps 92*a*, 92*b* therebetween, as shown in FIG. 7D. Conductive feedthroughs 90 provide external connection to metal strip electrodes 46*a*, 46*b*, 46*c* through glass bulb 40". Optionally, high resistivity material may be applied as a coating in the gaps 92*a*, 92*b*, between electrodes 46*a*, 46*b*, 46*c*.

Figure 9:
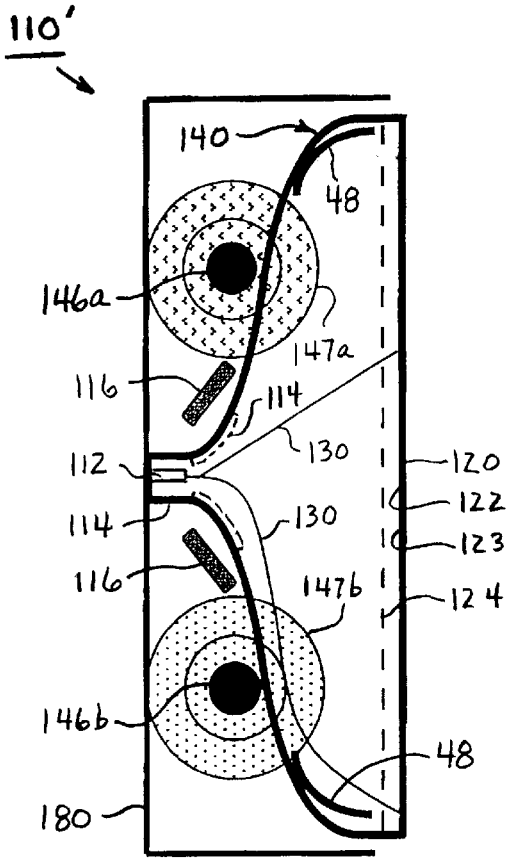
FIG. 9 is a cross-sectional schematic diagram of an alternative exemplary structure providing appropriately positioned electromagnets proximate a cathode ray tube to establish a predetermined magnetic field therein in accordance with the invention.
Figure 10:
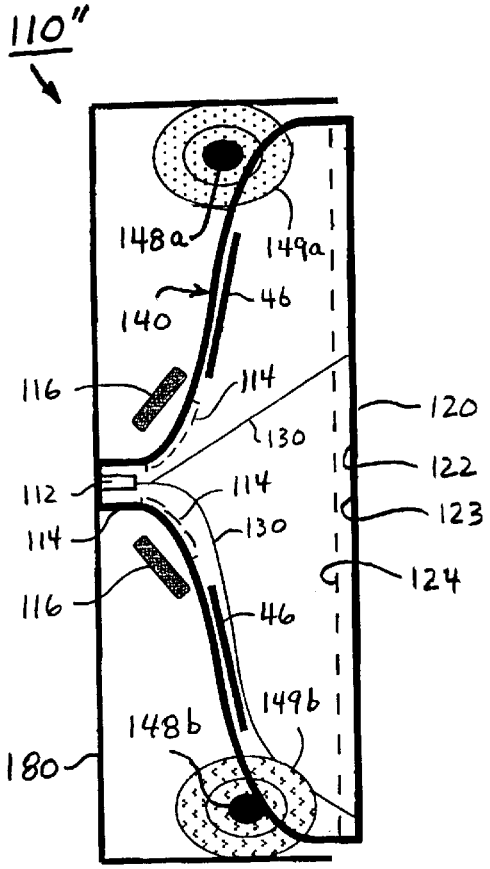
FIG. 10 is a cross-sectional schematic diagram of an alternative exemplary structure providing appropriately positioned electromagnets proximate a cathode ray tube to establish a predetermined magnetic field therein in accordance with the invention.

Other arrangements of exemplary structures providing appropriately positioned electromagnets proximate a cathode ray tube to establish predetermined magnetic fields therein are described in relation to the cross-sectional diagrams of FIGS. 8, 9 and 10. Therein a cathode ray tube 110, 110' or 110" has a funnel-shaped glass bulb 140 having a rearward projecting neck 114 in which is mounted electron gun 112 that produces electron beam 130. The forward end of glass bulb 140 is sealed to glass faceplate 120 to form a container that can be evacuated. Magnetic deflection yoke 116 surrounds the electron beam 130 where it exits electron gun 112 for magnetically deflecting beam 130 to produce a conventional raster scan on faceplate 120. Screen electrode 122 and phosphor pattern 123 are on the interior surface of faceplate 120 from which is spaced apart shadow mask 124 in conventional manner. An optional first or neck electrode 144 may be formed in any of tubes 110, 110', 110" by a deposited conductive coating surrounding and proximate the juncture of neck 114, such as a deposited metal electrode pattern, that receives bias potential, for example, via a conductive feedthrough penetrating the wall of glass bulb 140 or via a resistive voltage divider. An enclosure 180 encloses tube 110, 110', 110" desirably includes a ferromagnetic material, such as mu-metal, steel or a nickel-iron alloy to both shield tube 110, 110', 110" from external magnetic fields and to reduce the external magnetic field produced by electromagnets associated with tube 110, 110' and 110".

In the exemplary embodiment of FIG. 8, cathode ray tube 110 includes a first pair of electromagnets 146*a*, 146*b* proximate tube envelope 140 intermediate deflection yoke 116 and faceplate 120 to produce magnetic fields within tube envelope 140 illustrated by field contours 147*a* and 147*b*, respectively. A second pair of electromagnets 148*a*, 148*b* are proximate tube envelope 140 intermediate first electromagnets 146*a*, 146*b* and faceplate 120 to produce magnetic fields within tube envelope 140 illustrated by field contours 149*a* and 149*b*, respectively. Field lines within field contours 147*a*, 147*b*, 149*a*, 149*b* are shown by a pattern of dot "·" symbols to indicate field lines directed out of the paper and by a pattern of "<" and ">" symbols to indicate field lines directed into the paper.

The fields produced by electromagnets 146*a*, 146*b* are poled so that the electrons of electron beam 130 that pass within their influence are further deflected toward the edges of faceplate 120, i.e. electromagnets 146*a*, 146*b* act as deflection amplifiers or as yoke amplifiers, as described above. The field produced by electromagnet 148*a* is poled oppositely to the field of deflection aiding electromagnet 146*a* and the field produced by electromagnet 148*b* is poled oppositely to the field of deflection aiding electromagnet 146*b* so that the electrons of electron beam 130 that pass within their respective field are directed back toward faceplate 120, i.e. electromagnets 148*a*, 148*b* act to increase the landing angle of the electrons of beam 130 affected thereby on faceplate 120, as described above.

Current source 170 provides substantially fixed currents $I_{146}$ and $I_{148}$ that are applied to electromagnets 146, 146*a*, 146*b*, and 148, 148*a*, 148*b*, respectively, to establish the magnetic fields provided thereby. Generally, in view of the substantial symmetry of each of the electromagnets forming electromagnet 146 (be it a pair of electromagnets or a pair of sets of electromagnets 146*a*, 146*b*), and those likewise forming electromagnet 148, the electromagnets of each pair of electromagnets 146, 148, may beneficially be connected in series to be biased by the same bias current. Where sets of electromagnets are employed, however, it may be desirable to apply the same bias current to both coils of each set, e.g., a first current to both coils 146*a* and a second current to both coils 146*b*, but to separately generate the currents that are applied to each set. Alternatively, the same current could be utilized to drive plural sets; desirably, however, means for separately adjusting the current levels in each set, such as a parallel resistance or other shunting path, could be provided. Also alternatively, one or more of the electromagnets could be replaced by permanent magnets producing equivalent magnet fields.

It is noted that the interior surface of tube envelope 140 may be coated with a conductive material that is biased at a high positive potential, such as the screen 22 potential, so that the electrons of electron beam 130 are in a "drift" region free of electrostatic fields after they leave the influence of deflection yoke 116. Further, electrode 144, conveniently also a conductive coating, is biased at an intermediate potential, e.g., between 10 kV and 20 kV where the screen 22 is biased at about 30 kV, so as to slightly slow the electrons of electron beam 130 thereby tending to increase the effectiveness of deflection yoke 116.

In the exemplary alternative embodiment shown in FIG. 9, cathode ray tube 110' includes a first pair of electromagnets 146*a*, 146*b* proximate tube envelope 140 intermediate deflection yoke 116 and faceplate 120 to produce magnetic fields within tube envelope 140 illustrated by field contours 147*a* and 147*b*, respectively, as for FIG. 8 above. An electrode 48 proximate tube envelope 140 intermediate first electromagnets 146*a*, 146*b* and faceplate 120 is biased at a positive potential to produce an electrostatic field within tube envelope 140. The fields produced by electromagnets 146*a*, 146*b* are poled so that the electrons of electron beam 130 that pass within their influence are further deflected toward the edges of faceplate 120, i.e. electromagnets 146*a*, 146*b* act as deflection amplifiers or as yoke amplifiers, as described above, and tend to bend electron beam 130 away from faceplate 20. The field produced by electrode 48 tends to bend electron beam 130 oppositely to the fields of deflection aiding electromagnets 146*a* and 146*b* so that the electrons of electron beam 130 that pass within their respective field are directed back toward faceplate 120, i.e. electrode 48 acts to increase the landing angle of the electrons of beam 130 affected thereby on faceplate 120, as described above.

In the exemplary alternative embodiment of FIG. 10, cathode ray tube 110" includes a first pair of electromagnets 148*a*, 148*b* proximate tube envelope 140 and close to faceplate 120 to produce magnetic fields within tube envelope 140 illustrated by field contours 149*a* and 149*b*, respectively. An electrode 46 on or proximate tube envelope 140 intermediate the tube neck 114—deflection yoke 116 region and first electromagnets 148*a*, 148*b* is biased at a positive potential to produce an electrostatic field within tube envelope 140. The electrostatic field produced by electrode 46 tends to bend the electrons of electron beam 130 that pass within their influence away from faceplate 120 so that those electrons are further deflected toward the edges of faceplate 120, i.e. electrode 46 acts as a deflection amplifier or a yoke amplifier, as described above. The oppositely poled fields produced by electromagnets 148*a*, 148*b* are poled to tend to bend the electrons of electron beam 130 oppositely to the field of deflection aiding electrode 46, so that the electrons of electron beam 130 that pass within their respective fields are directed back toward faceplate 120, i.e. electromagnets 148*a*, 148*b* act to increase the landing angle of the electrons of beam 130 affected thereby on faceplate 120, as described above.

Figure 11B:
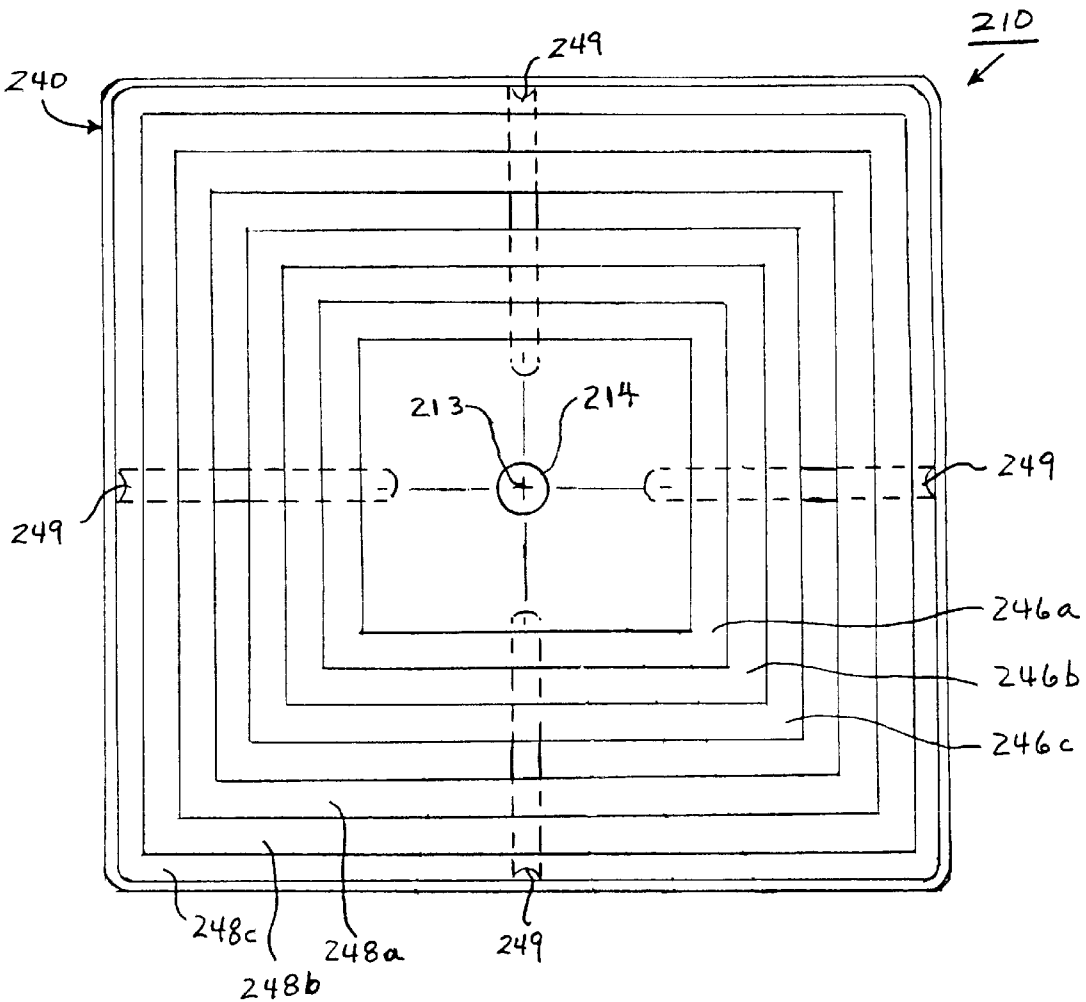
FIGS. 11A and 11B are a side view cross-sectional and a front view schematic diagram, respectively, of an alternative exemplary structure providing electrodes appropriately positioned within a cathode ray tube for use with electromagnets in accordance with the invention.
Figure 11A:
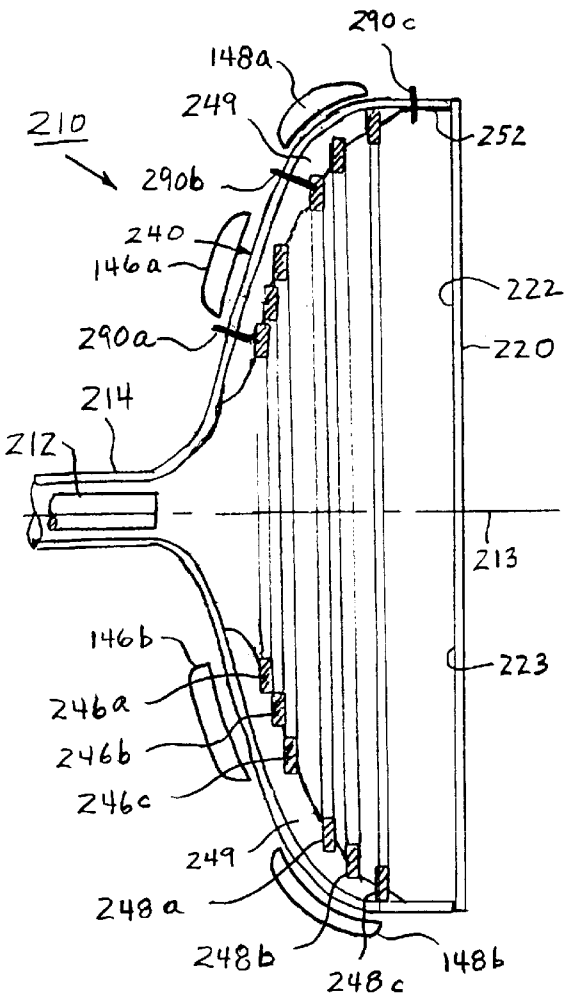

FIG. 11A is a side cross-sectional diagram of cathode ray tube 210 and FIG. 11B is a front view diagram of cathode ray tube 210 (with faceplate 220 removed) illustrating an alternative exemplary structure providing appropriately positioned electrodes 246, 248 within cathode ray tube 210 for use in a cathode ray tube having at least one pair of electromagnets, in accordance with the invention. One or the other of electrodes 246 and 248 would be employed with electromagnet pair 148 and 146, respectively, in a tube in accordance with the invention. Each of the electrodes 246, 248 has a generally rectangular ring-like shape of respectively larger dimension to form an array of spaced apart ring electrodes 246, 248 symmetrically disposed within the interior of funnel-shaped glass bulb 240 of cathode ray tube 210. The electrodes are preferably stamped metal, such as steel, of generally rectangular shape with a generally rectangular aperture (i.e. a region through which electrons pass and are influenced by the electric field produced by the bias potential applied to such electrode), and are mounted within glass bulb 240 by a plurality of mounts, such as elongated glass beads 249, although clips, brackets and other mounting arrangements may be employed.

Assembly is quick and economical where the rectangular metal electrodes 246, 248 are substantially simultaneously secured in their respective relative positions in the four glass beads 249 with the glass beads 249 positioned, for example, at four locations such as the 12 o'clock, 3 o'clock, 6 o'clock and 9 o'clock (i.e. 0°, 90°, 180° and 270°) positions as shown, thereby to form a rigid, self-supporting structure. The assembled electrode structure is then inserted, properly positioned and secured within glass bulb 240, and faceplate 220 is then attached and sealed.

Appropriate electrical connections of predetermined ones of electrodes 246, 248 are made to bias potential feedthroughs 290 penetrating the wall of glass bulb 240. Electrical connections between ones of feedthroughs 290 and predetermined ones of rectangular electrodes 246, 248 are made by welding or by snubbers on the electrodes that touch the feedthrough 290 conductors. Feedthroughs 290 need be provided only for the highest and lowest bias potentials because intermediate potentials are obtained by resistive voltage dividers connected to the feedthroughs 290 and appropriate ones of rectangular electrodes 246, 248. High positive potential from feedthrough 290*c* is conducted to screen electrode 222 by deposited conductor 252 and to gun 212. Rectangular electrodes 246, 248 can be made of a suitable metal to provide magnetic shielding, such as mu-metal, steel, or a nickel-steel alloy, or one or more magnetic shields could be mounted external to glass bulb 240. Electron gun 212, faceplate 220, screen electrode 224 and phosphors 223 are substantially like the corresponding elements described above.

FIG. 12 is a partial cross-sectional diagram of a cathode ray tube 310 showing an alternative mounting arrangement for a set of generally rectangular electrodes 346 having generally rectangular apertures mounted within the interior of funnel-shaped glass bulb 340 to deflect electron beam 330 as described above. Electrode 346 would be employed with a pair of electromagnets 348, which may be a pair of complementary electromagnets or may be two complementary sets of electromagnets 348*a*, 348*b*, as illustrated. Electron gun 312, neck 314, faceplate 320, phosphors 323, shadow mask 324 and frame 326, glass bulb 340 are disposed symmetrically relative to tube centerline 313, and may include a getter material in the space between glass bulb 340 and electrodes 346, all of the foregoing being substantially as described above.

Electrodes 346 are formed as a set of generally rectangular loops of ascending dimension, for example, six loop sub-electrodes 346*a*, 346*b*, 346*c*, . . . 346*f*, and are positioned symmetrically with respect to tube central axis 313 with the smallest more proximate neck 314 and the largest more proximate faceplate 320. Plural support structures 360 are employed to support electrodes 346, such as four supports 360 disposed 90° apart, only one of which is visible in FIG. 12. Each support structure 360 is generally shaped to follow the shape of glass bulb 340 and is mounted, for example, between and attached to two insulating supports 349, such as glass beads or lips, one proximate shadow mask frame 326 and one proximate neck 314. Each of electrodes 346*a*–346*f* is electrically isolated from the other ones thereof, unless it is desired that two or more of electrodes 346*a*–346*f* be at the same bias potential. Electrodes 346*a*–346*f* are preferably of stamped metal, such as titanium, steel or aluminum, and are preferably of a magnetic shielding metal such as mu-metal or a nickel-steel alloy to shield electron beam 330 from unwanted deflection caused by the earth's magnetic field and other unwanted fields.

Each support strip 360 is formed of a layered structure of a metal base 362, such as a titanium strip, for strength, a ceramic or other insulating material layer 364 on at least one side of the metal base 362, and spaced weldable contact pads 368 including a weldable metal, such as nickel or nichrome, to which the electrodes 346*a*, 346*b*, . . . are welded, as shown in the expanded inset of FIG. 12. Weldable pads 368 are electrically isolated from each other and from metal base 362 by ceramic layer 364, so that different bias potentials may be established on each of generally rectangular electrodes 346*a*–346*f*.

Preferably, one or more of support strips 360 includes a high-resistivity electrical conductor 366, such as ruthenium oxide, preferably formed in a serpentine pattern on ceramic layer 364 to provide resistors having a high resistance, e.g., on the order of $10^9$ ohms, that together form a resistive voltage divider that apportions the bias potentials applied at feedthroughs 390 to develop the desired bias potential for each one of electrodes 346*a*–346*f*. A ceramic layer 364 may be placed on one or both sides of metal base strip 362, and a resistive layer 366 may be formed on either or both of ceramic layers 364. A portion of one side of an exemplary support structure having serpentine high-resistance resistors 366 between weldable contact pads 368 on ceramic insulating layer 364 is illustrated in FIG. 13. Electrical connections may be made from selected appropriate ones of contact pads 368 to gun 312 and to screen electrode 322 for applying respective appropriate bias potentials thereto. Support strips 360 are preferably formed of fired laminates of the metal base and ceramic insulating and ceramic circuit layers, such as the low-temperature co-fired ceramic on metal (LTCC-M) process described in U.S. Pat. No. 5,581,876 entitled "Method of Adhering Green Tape To A Metal Substrate With A Bonding Glass."

Electrodes 346 and support strips 360 are assembled together into an assembly having sufficient strength to maintain its shape (owing to the strength of each component thereof) and the assembled electrodes are inserted into the interior of glass bulb 340 to the desired position, and the assembly is held in place by clips or welds not visible) near the shadow mask frame 326 and support 349 near neck 314. The assembled structure of electrodes 346 and support strips 360 preferably conforms approximately to the interior shape of glass bulb 340 and is slightly spaced away therefrom. However, the structure of electrodes 346 and support strips 360 is positioned outside the volume through which electron beam 330 passes at any position in its scan including the extremes of deflection produced by the magnetic deflection yoke (not shown) and the amplified deflection produced by the electrostatic forces resulting from the bias potentials applied to electrodes 346. Electrodes 346*a*–346*f* are preferably shaped so as to shield objects behind them, such as support strips 360 and uncoated areas of the inner surface of glass bulb 340, and getter materials, from impingement of electrons from electron beam 330.

In any of the foregoing embodiments, each of electromagnets 146, 146*a*, . . . , 148, 148*a*, . . . are copper or other suitable insulated magnet wire wound on a shaped core of a suitable magnetic material, such as a core of ferrite, powdered iron or other ferromagnetic material. Preferably, the core is shaped generally to follow the shape of the tube envelope of the cathode ray tube to which it is to be attached, and more preferably, to be shaped so that the contour of the wound electromagnet closely conforms to the tube envelope. Where a conductive coating or electrode is on the surface of the tube envelope, such as a faceplate 20, 120, 220, 320, 420 and so forth, such coating or electrode is preferably a sprayed, sublimated, spin coated or other deposition or application of graphite or carbon-based materials, aluminum or aluminum oxide or other suitable conductive material. Where electrodes, such as electrodes 46*a*–46*c*, 246*a*–246*c*, 248*a*–248*c*, 344*a* . . . 348*f*, and so forth, are spaced away from the wall of tube envelope 40, 140, 240, 340, 440 and so forth, such electrodes are preferably formed of a suitable metal such as a titanium, Invar alloy, steel, stainless steel, or other suitable metal.

While the present invention has been described in terms of the foregoing exemplary embodiments, variations within the scope and spirit of the present invention as defined by the claims following will be apparent to those skilled in the art. For example, the present cathode ray tube can be a monochrome tube having a phosphor coating on the inner surface of the faceplate thereof or may be a color tube having a pattern of color phosphors thereon and a shadow mask or other screen, mask or device having a pattern of apertures corresponding to the pattern of color phosphors, whether described herein as having or not having a shadow mask. Where a higher efficiency shadow mask or the like is available, such as a shadow mask that enables a larger proportion of the electrons of electron beam to pass through the apertures thereof, such high-efficiency shadow mask could be employed in cathode ray tubes of the present invention, thereby resulting in one or more of increased brightness, reduced spot size or reduced gun diameter (and the benefit of increased deflection angle or reduced yoke power associated therewith).

It is noted that one or more permanent magnets producing a magnetic field equivalent to that produced by any one or more electromagnets may be substituted for such one or more of the electromagnets described herein.

In addition, the shape of the glass tube funnel may be shaped to conform relatively closely to the trajectories of the electron beam trajectories landing at the edges and corners of the tube, but to be slightly spaced away therefrom. Thus, the electro magnets or permanent magnets mounted to the exterior of the funnel will be closer to the electron trajectories which decreases the magnetic field required to obtain a given bending of the electron trajectories. Thus, the size of the magnets and/or the electrical power needed to produce such magnetic field is reduced.

Bias potentials developed by voltage dividers may be developed by resistive voltage dividers formed of discrete resistors, blocks of high-resistivity material, coatings of high-resistivity material and other suitable voltage dividers. The bias potential applied to the peripheral electrode 48, 248 is preferably less than the screen potential.

What is claimed is:

1. A tube comprising:

a tube envelope having a faceplate and a screen electrode on the faceplate adapted to be biased at a screen potential, wherein the faceplate has a longer horizontal dimension and a shorter vertical dimension;

a source of at least one beam of electrons directed toward said faceplate, wherein said source is adapted for magnetic deflection of said at least one beam of electrons;

phosphorescent material disposed on said faceplate for producing light in response to the at least one beam of electrons impinging thereon; and at least first and second magnetic sources each being disposed proximate said tube envelope to produce a respective magnetic field therein, said first and second magnetic sources being disposed oppositely with respect to said source of at least one beam of electrons with said source of at least one beam of electrons between said first and second magnetic sources, the fields of said first and second magnetic sources tending to bend the at least one beam of electrons in a direction away from the center of said faceplate in the longer horizontal dimension thereof.

2. The tube of claim 1 wherein said first and second magnetic sources comprise first and second electromagnets disposed proximate said tube envelope intermediate said source of at least one beam of electrons and said faceplate, and wherein said first and second electromagnets are oppositely poled for said tending to bend the at least one beam of electrons in a direction away from said faceplate.

3. The tube of claim 2 wherein said source of at least one beam of electrons is positioned symmetrically respecting said faceplate, and wherein said first and second electromagnets are substantially symmetrically disposed relative to said source of at least one beam of electrons.

4. The tube of claim 2 wherein each of said first and second electromagnets includes a plurality of a given number of electromagnets, wherein each of the plurality of electromagnets of said first electromagnet is poled in a first sense and each of the plurality of electromagnets of said second electromagnet is poled in a second sense opposite to the first sense.

5. The tube of claim 4 wherein each electromagnet of said first and second electromagnets is shaped to substantially conform to said tube envelope.

6. The tube of claim 2 wherein said first and second electromagnets are shaped to substantially conform to said tube envelope.

7. The tube of claim 1 further comprising an electrode interior said tube envelope and closer to said faceplate than said first and second magnetic sources, said electrode being adapted to be biased at a potential not exceeding the screen potential for producing an electric field in a region through which the at least one beam of electrons passes.

8. The tube of claim 7 wherein said electrode includes one of a conductive material on an interior surface of said tube envelope and a metal electrode proximate the interior surface of said tube envelope.

9. The tube of claim 1 further comprising a shadow mask proximate said faceplate having a plurality of apertures therethrough, said shadow mask adapted to be biased at the screen potential, and wherein said source of at least one beam of electrons produces plural beams of electrons and said phosphorescent material includes a pattern of different phosphorescent materials on said faceplate that emit different color light in response to the plural beams of electrons impinging thereon through the apertures of said shadow mask.

10. A tube comprising:

a tube envelope having a faceplate and a screen electrode on the faceplate adapted to be biased at a screen potential;

a source of at least one beam of electrons directed toward said faceplate, wherein said source is adapted for magnetic deflection of said at least one beam of electrons;

phosphorescent material disposed on said faceplate for producing light in response to the at least one beam of electrons impinging thereon;

at least first and second magnetic sources each being disposed proximate said tube envelope to produce a respective magnetic field therein, said first and second magnetic sources being disposed oppositely with respect to said source of at least one beam of electrons with said source of at least one beam of electrons between said first and second magnetic sources, the fields of said first and second magnetic sources tending to bend the at least one beam of electrons in a direction away from the center of said faceplate; and at least third and fourth magnetic sources each producing a respective magnetic field and being disposed proximate said tube envelope, said third magnetic source being disposed intermediate said first magnetic source and said faceplate and said fourth magnetic source being disposed intermediate said second magnetic source and said faceplate, wherein said third and fourth magnetic sources are oppositely poled for tending to bend the at least one beam of electrons in a direction toward said faceplate.

11. The tube of claim 10 wherein said third and fourth magnetic sources comprise at least third and fourth electromagnets disposed proximate said tube envelope, wherein said third and fourth electromagnets are oppositely poled for said tending to bend the at least one beam of electrons in a direction toward said faceplate.

12. The tube of claim 11 wherein said source of at least one beam of electrons is positioned symmetrically respecting said faceplate, and wherein said third and fourth electromagnets are substantially symmetrically disposed relative to said source of at least one beam of electrons.

13. The tube of claim 11 wherein said source of at least one beam of electrons is positioned symmetrically respecting said faceplate, and wherein said first and second electromagnets and said third and fourth electromagnets are respectively substantially symmetrically disposed relative to said source of at least one beam of electrons.

14. The tube of claim 11 wherein said third and fourth electromagnets are shaped to substantially conform to said tube envelope.

15. The tube of claim 10 wherein said at least one of said first, second, third and fourth magnetic sources is shaped to conform to said tube envelope.

16. The tube of claim 10 wherein at least one of said first, second, third and fourth magnetic sources includes a permanent magnet.

17. A tube comprising:

a tube envelope having a faceplate and a screen electrode on the faceplate adapted to be biased at a screen potential;

a source of at least one beam of electrons directed toward said faceplate, wherein said source is adapted for magnetic deflection of said at least one beam of electrons;

phosphorescent material disposed on said faceplate for producing light in response to the at least one beam of electrons impinging thereon; and at least first and second magnetic sources each being disposed proximate said tube envelope to produce a respective magnetic field therein, said first and second magnetic sources being disposed oppositely with respect to said source of at least one beam of electrons with said source of at least one beam of electrons between said first and second magnetic sources, the fields of said first and second magnetic sources tending to bend the at least one beam of electrons in a direction away from the center of said faceplate; and an electrode interior said tube envelope and closer to said faceplate than said first and second magnetic sources, said electrode being adapted to be biased at a potential not exceeding the screen potential for producing an electric field in a region through which the at least one beam of electrons passes, wherein said electrode includes a plurality of sub-electrodes adapted to be biased at different potentials.

18. The tube of claim 17 further comprising at least one of (a) means electrically connecting at least one of said sub-electrodes to a conductor penetrating said tube envelope, and (b) a voltage divider within said tube envelope and adapted for receiving a bias potential for developing at least one of the potentials at which one of said sub-electrodes are adapted to be biased.

19. A tube comprising:

a tube envelope having a faceplate and a screen electrode on the faceplate adapted to be biased at a screen potential;

a source of at least one beam of electrons directed toward said faceplate, wherein said source is adapted for magnetic deflection of said at least one beam of electrons;

phosphorescent material disposed on said faceplate for producing light in response to the at least one beam of electrons impinging thereon;

at least a first pair of electromagnets disposed proximate said tube envelope intermediate said source of at least one beam of electrons and said faceplate, wherein said source of at least one beam of electrons is intermediate the electromagnets of said first pair of electromagnets, and wherein said first pair of electromagnets are oppositely poled for tending to bend the at least one beam of electrons in a direction away from the center of said faceplate, thereby to increase the deflection thereof; and an electrode interior said tube envelope and closer to said faceplate than said first pair of electromagnets, said electrode being adapted to be biased at a potential not exceeding the screen potential for producing an electric field in a region through which the at least one beam of electrons when bent by said at least first pair of electromagnets in a direction away from the center of the faceplate passes for tending to bend the at least one beam of electrons in a direction toward said faceplate, whereby the beam of electrons is bent in a direction away from the center of the faceplate to increase the deflection thereof and is then bent in a direction toward the faceplate to increase the landing angle thereof on the faceplate.

20. A tube comprising:

a tube envelope having a faceplate and a screen electrode on the faceplate adapted to be biased at a screen potential;

a source of at least one beam of electrons directed toward said faceplate, wherein said source is adapted for magnetic deflection of said at least one beam of electrons;

phosphorescent material disposed on said faceplate for producing light in response to the at least one beam of electrons impinging thereon;

at least a first pair of electromagnets disposed proximate said tube envelope intermediate said source of at least one beam of electrons and said faceplate, wherein said source of at least one beam of electrons is intermediate the electromagnets of said first pair of electromagnets, and wherein said first pair of electromagnets are oppositely poled for tending to bend the at least one beam of electrons in a direction toward said faceplate; and an electrode interior said tube envelope and farther from said faceplate than said first pair of electromagnets, said electrode being adapted to be biased at a potential not less than screen potential for producing an electric field in a region through which the at least one beam of electrons passes for tending to bend the at least one beam of electrons in a direction away from the center of said faceplate.

21. A cathode ray tube comprising:

a tube envelope having a generally flat faceplate and a screen electrode on the faceplate adapted to be biased at a screen potential, and having a tube neck opposite said faceplate, wherein said faceplate has a longer dimension and a shorter dimension;

in said tube neck, a source of at least one beam of electrons directed toward said faceplate, wherein said source is adapted for magnetic deflection of said at least one beam of electrons;

a deflection yoke around said tube neck for deflecting the at least one beam of electrons from said source over a predetermined range of deflection angles, whereby the deflected at least one beam of electrons impinges upon a given portion of the area of the screen electrode;

phosphorescent material disposed on said faceplate for producing light in response to the at least one beam of electrons impinging thereon; and at least first and second electromagnets mounted on said tube envelope, each intermediate said source of at least one beam of electrons and said faceplate, said first electromagnet being positioned diametrically opposite said second electromagnet, wherein said first and second electromagnets are oppositely poled for deflecting the at least one beam of electrons in a direction away from the center of said faceplate in the longer dimension thereof, whereby the deflected at least one beam of electrons further deflected by at least said first and second electromagnets impinge on an area of said screen electrode that is larger than the given portion thereof.

22. The cathode ray tube of claim 21 further comprising a shadow mask proximate said faceplate having a plurality of apertures therethrough, said shadow mask adapted to be biased at said screen potential, and wherein said phosphorescent material includes a pattern of different phosphorescent materials that emit different respective colors of light in response to said at least one beam of electrons impinging thereon.

23. A cathode ray tube comprising:

a tube envelope having a generally flat faceplate and a screen electrode on the faceplate adapted to be biased at a screen potential, and having a tube neck opposite said faceplate disposed along a central axis substantially perpendicular to said faceplate, wherein said faceplate has a longer dimension and a shorter dimension;

in said tube neck, a source of at least one beam of electrons directed toward said faceplate, wherein said source is adapted for magnetic deflection of said at least one beam of electrons;

a deflection yoke around said tube neck for deflecting the at least one beam of electrons from said source over a predetermined range of deflection angles, whereby the deflected at least one beam of electrons impinge upon a given portion of the area of the screen electrode;

phosphorescent material disposed on said faceplate for producing light in response to the at least one beam of electrons impinging thereon; and at least first and second pairs of magnetic sources substantially symmetrically mounted on said tube envelope with respect to said central tube axis, each pair of magnetic sources being intermediate said source of at least one beam of electrons and said faceplate, the first magnetic source of each pair of magnetic sources being positioned diametrically opposite the second magnetic source of said pair, wherein said first and second pairs of magnetic sources are oppositely poled for said first pair of magnetic sources deflecting the at least one beam of electrons in a direction away from the center of said faceplate in the longer dimension thereof and for said second pair of magnetic sources deflecting the at least one beam of electrons in a direction toward said faceplate, whereby the deflected at least one beam of electrons further deflected by at least said first and second pairs of magnetic sources impinge on an area of said screen electrode that is larger than the given portion thereof.

24. The cathode ray tube of claim 23 wherein at least one of said first and second pairs of magnetic sources includes one of a pair of electromagnets and a pair of permanent magnets.

25. A display comprising:

a tube envelope having a faceplate and a screen electrode on the faceplate biased at a screen potential, wherein the faceplate has a larger dimension and a shorter dimension;

a source within said tube envelope of at least one beam of electrons directed toward said faceplate;

a deflection yoke proximate said source of at least one beam of electrons for magnetically deflecting said at least one beam of electrons;

phosphorescent material disposed on said faceplate for producing light in response to the at least one beam of electrons impinging thereon;

at least first and second electromagnets disposed proximate said tube envelope with said source of at least one beam of electrons intermediate said first and second electromagnets, wherein said first and second electromagnets are oppositely poled for tending to bend the at least one beam of electrons in a direction away from the center of said faceplate in the larger dimension thereof; and a source of direct current bias for said first and second electromagnets and of bias potential for said screen electrode.

26. The display of claim 25 wherein each of said first and second electromagnets includes a plurality of a given number of electromagnets, wherein each of the plurality of electromagnets of said first electromagnet is poled in a first sense and each of the plurality of electromagnets of said second electromagnet is poled in a second sense opposite to the first sense.

27. The display of claim 26 wherein each electromagnet of said first and second electromagnets is shaped to conform to said tube envelope.

28. A display comprising:

a tube envelope having a faceplate and a screen electrode on the faceplate biased at a screen potential;

a source within said tube envelope of at least one beam of electrons directed toward said faceplate;

a deflection yoke proximate said source of at least one beam of electrons for magnetically deflecting said at least one beam of electrons;

phosphorescent material disposed on said faceplate for producing light in response to the at least one beam of electrons impinging thereon;

at least first and second electromagnets disposed proximate said tube envelope with said source of at least one beam of electrons intermediate said first and second electromagnets, wherein said first and second electromagnets are oppositely poled for tending to bend the at least one beam of electrons in a direction away from the center of said faceplate;

at least third and fourth electromagnets disposed proximate said tube envelope intermediate said first and second electromagnets and said faceplate, wherein said third and fourth electromagnets are oppositely poled for tending to bend the at least one beam of electrons in a direction toward said faceplate: and a source of direct current bias for said first, second, third and fourth electromagnets and of bias potential for said screen electrode.

29. The display of claim 28 wherein said source of at least one beam of electrons is positioned symmetrically respecting said faceplate, and wherein at least one of said first and second electromagnets and of said third and fourth electromagnets are substantially symmetrically disposed relative to said source.

30. The display of claim 28 wherein said at least one of said first, second, third and fourth electromagnets is shaped to substantially conform to said tube envelope.

* * * * *